US005461294A

United States Patent [19]

Kitazawa

[11] Patent Number: 5,461,294

[45] Date of Patent: Oct. 24, 1995

[54] METHOD OF DETECTING THE STOP OF A REFRIGERATOR DAMPER, AND DEVICE FOR PRACTICING THE METHOD

[75] Inventor: Tomio Kitazawa, Nagano, Japan

[73] Assignee: Kabushiki Kaisha Sankyo Seiki Seisakusho, Nagono, Japan

[21] Appl. No.: 131,953

[22] Filed: Oct. 8, 1993

[30] Foreign Application Priority Data

Oct. 9, 1992 [JP] Japan ..... 4-296513

[51] Int. Cl.[6] ..... G05B 19/40

[52] U.S. Cl. ..... 318/685; 318/449; 318/466; 318/468; 318/560

[58] Field of Search ..... 318/449, 466, 318/468, 479, 560, 685

[56] References Cited

U.S. PATENT DOCUMENTS

| | | | |
|---|---|---|---|
| 4,834,283 | 5/1989 | Akabane et al. | 318/468 |
| 5,038,087 | 8/1991 | Archer et al. | 318/469 |
| 5,057,859 | 10/1991 | Ishimaru | 318/685 |
| 5,204,592 | 4/1993 | Huyer | 318/466 |
| 5,210,562 | 5/1993 | Miyazawa et al. | 318/685 |
| 5,291,114 | 3/1994 | Shirotori et al. | 318/685 |

FOREIGN PATENT DOCUMENTS

| | | |
|---|---|---|
| 0036931 | 10/1981 | European Pat. Off. . |
| 0217605 | 4/1987 | European Pat. Off. . |
| 58-87083 | 6/1983 | Japan . |
| 60-2271 | 1/1985 | Japan . |
| 2202969 | 5/1988 | United Kingdom . |

*Primary Examiner*—William M. Shoop, Jr.
*Assistant Examiner*—Karen Masih
*Attorney, Agent, or Firm*—Sughrue, Mion, Zinn, Macpeak & Seas

[57] ABSTRACT

A device for detecting the stop of a stepping-motor-operated damper for a refrigerator, the damper having a stepping motor, a baffle driven by the stepping motor, a rotation control unit for controlling the direction of rotation and the amount of rotation of the stepping motor. The device includes a memory unit for storing a set value for detecting a position where the baffle is stopped, a measuring unit for measuring an electrical drive signal provided when the baffle is being driven, a comparison unit for comparing the electrical drive signal with the set value, and a stop detecting unit for determining that the baffle has been stopped when the comparison unit determines that the electrical drive signal is larger than the set value, to output a stop signal.

7 Claims, 5 Drawing Sheets

METHOD OF DETECTING THE STOP OF A REFRIGERATOR DAMPER, AND DEVICE FOR PRACTICING THE METHOD

BACKGROUND OF THE INVENTION

This invention relates to a stepping-motor-operated damper for opening and closing a baffle which is faced with a cold air intake of a refrigerator, and more particularly to a method of electrically detecting the position where the baffle is stopped.

A recent refrigerator has a freezing chamber and a refrigerating chamber. The refrigerating chamber is divided, for instance, into two parts, and the cold air in the freezing chamber is supplied into the two refrigerating chambers.

The supply of the cold air is controlled by operating, opening and closing, dampers which are provided in passageways connected between the freezing chamber and the two refrigerating chambers.

The refrigerator damper operates as follows: Two operating modes, namely, a fully opening mode and a fully closing mode, of a baffle driven by an AC synchronous motor are detected with a reed switch. In response to the operation modes thus detected, the baffle is operated to control the supply of the cold air thereby to control the temperature of the refrigerator.

On the other hand, Unexamined Japanese Utility Publication No's Sho. 58-87083 and Sho. 60-2271 have disclosed a technique that instead of the AC synchronous motor, a pulse motor, a typical example of which is a stepping motor, is employed.

In this case, the switch often becomes out of order at low temperatures, and in addition the freezing of the baffle cannot be detected in a short time. Hence, sometimes the refrigerator is unsatisfactory in operation.

SUMMARY OF THE INVENTION

Accordingly, an object of the present invention is to provide a method of detecting the stop of a stepping-motor-operated damper for a refrigerator in which the baffle is driven by a stepping motor, so that the degree of opening of the baffle is controlled according to the reference position which is the position where the baffle is completely closed, furthermore the abnormal condition, such as freezing, of the baffle can be detected at an early stage.

In order to attain the above-mentioned object, the present invention provides a device for detecting the stop of a stepping-motor-operated damper for a refrigerator, the damper having a stepping motor, a baffle driven by the stepping motor, a rotation control unit for controlling the direction of rotation and the amount of rotation of the stepping motor. The device includes a memory unit for storing a set value for detecting a position where the baffle is stopped, a measuring unit for measuring an electrical drive signal provided when the baffle is being driven, a comparison unit for comparing the electrical drive signal with the set value, and a stop detecting unit for determining that the baffle has been stopped when the comparison unit determines that the electrical drive signal is larger than the set value, to output a stop signal.

BRIEF DESCRIPTION OF THE DRAWINGS

In the more detailed description of the preferred embodiment of the invention set forth below, reference is made to the attached drawings which form a part of the application, and which.

DETAILED DESCRIPTION OF THE PREFERRED EMBODIMENTS

Figure 1:
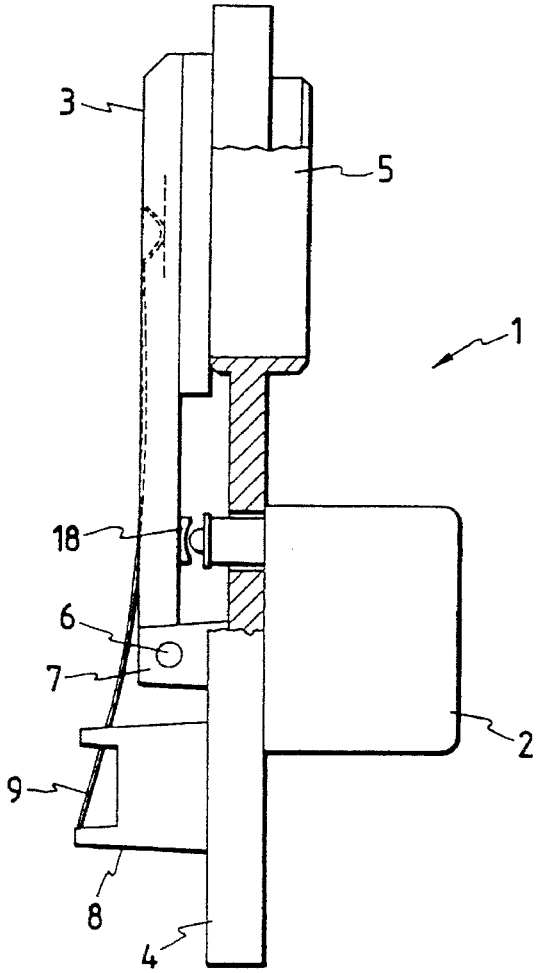
FIG. 1 is a side view, with parts cut away, showing a refrigerator damper according to this invention.
Figure 3:
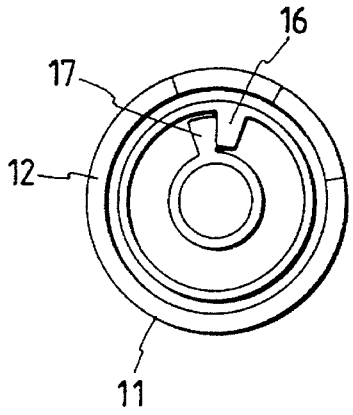
FIG. 3 is a plan view showing the positional relation between a stopper and a reference position stopper in the refrigerator damper.
Figure 2:
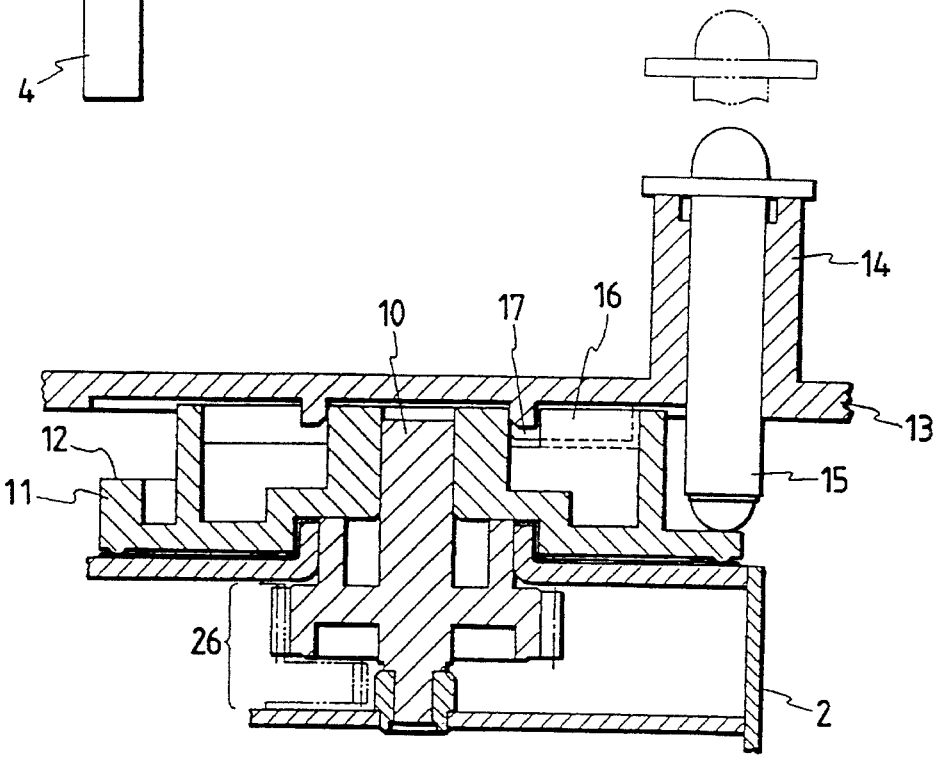
FIG. 2 is an enlarged sectional view of a stepping motor and a cam member in the refrigerator damper.

FIGS. 1, 2 and 3 show the mechanical arrangement of a stepping-motor-operated damper 1. The damper 1 has a rotating source, namely, a stepping motor 2, and a baffle 3 which is driven by the stepping motor 2. The motor 2 and the baffle 3 are mounted on a frame 4. The frame 4 is in the form of a plate having a cold air intake 5 in the upper portion. The baffle 3 is positioned on one side of the frame 4 in such a manner that it is confronted with the cold air intake 5. The baffle 3 has a supporting shaft 6 at the lower end, which is rotatably supported by bearings 7 which are integral with the frame 4. The baffle 3 is maintained with biasing force in the direction of closing the cold air intake 5 by a plate spring 9 secured to a spring stand 8 of the frame 4.

The stepping motor 2 incorporates a reduction gear 26, as shown in FIG. 2. The motor 2 is mounted on the other side of the frame 4, that is, it is confronted through the frame 4 with the baffle 3. The torque of the reduction gear 26 is transmitted to an end face cam 11 fixedly mounted on the output shaft 10 of the motor. The end face cam 11 has a sloped cam surface 12 and a stopper 16. The sloped cam surface 12 is in contact with one end of a spindle 15 which is slidably set in a guide cylinder 14 extended from a casing 13. As shown in FIG. 2 and 3, when the stopper 16 abuts against a reference position stopper 17 which is formed integrally on the casing 13, the baffle 3 comes to a reference position, where it completely closes the cold air intake 5. The other end of the spindle 15 is in contact with a spindle receiver 18 formed on the baffle 3. Therefore, when the spindle 15 pushes the baffle 3 against the elastic force of the plate spring 9, the cold air intake 5 is opened.

Figure 4:
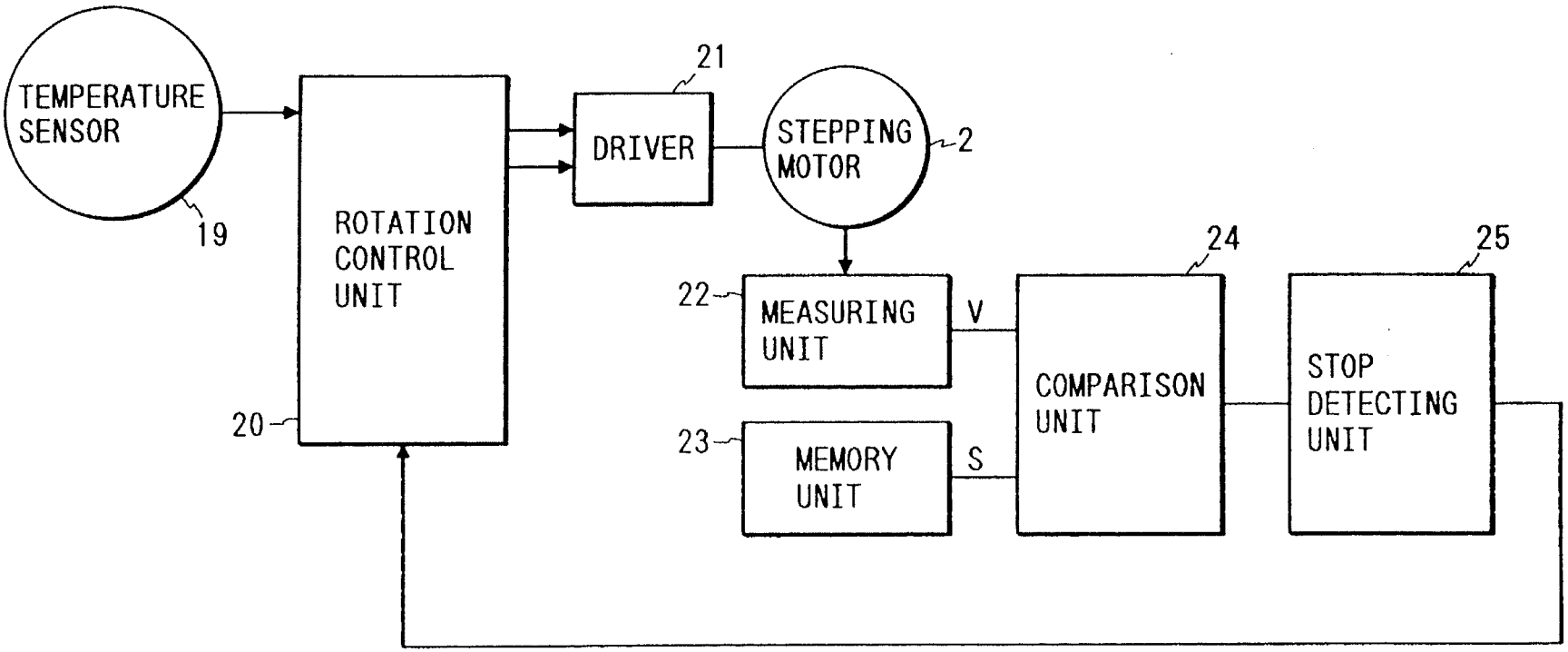
FIG. 4 is a block diagram showing the arrangement of a control section for the stepping motor in the refrigerator damper.

FIG. 4 shows a control section for the stepping motor 2. In the control section, a rotation control unit 20 such as a CPU (central processing unit), which has a program required for controlling the rotation of the stepping motor according to the method of the present invention, controls a driver 21 in response to signals from a temperature sensor 19 thereby to control the direction of rotation and the amount of rotation of the stepping motor 2. The stepping motor 2 is connected to a measuring unit 22. The measuring unit 22 and a memory unit 23 are connected to a comparison unit 24, which is connected through a stop detecting unit 25 to the rotation control unit 20.

The measuring unit 22 measures an electrical drive signal, namely, a voltage V applied to the stepping motor 2. The memory unit 23 stores a set value S which is predetermined in advance, in order to detect whether or not the baffle 3 is stopped operating. The voltage V and the set value S are applied to the comparison unit 24, where they are subjected to comparison. The comparison unit 24 outputs a signal according to the result of comparison. Upon reception of the signal which the comparison unit 24 outputs when the voltage V exceeds the set value S, the stop detecting unit 25 determines that the baffle has been stopped, and outputs a stop signal.

Figure 5:
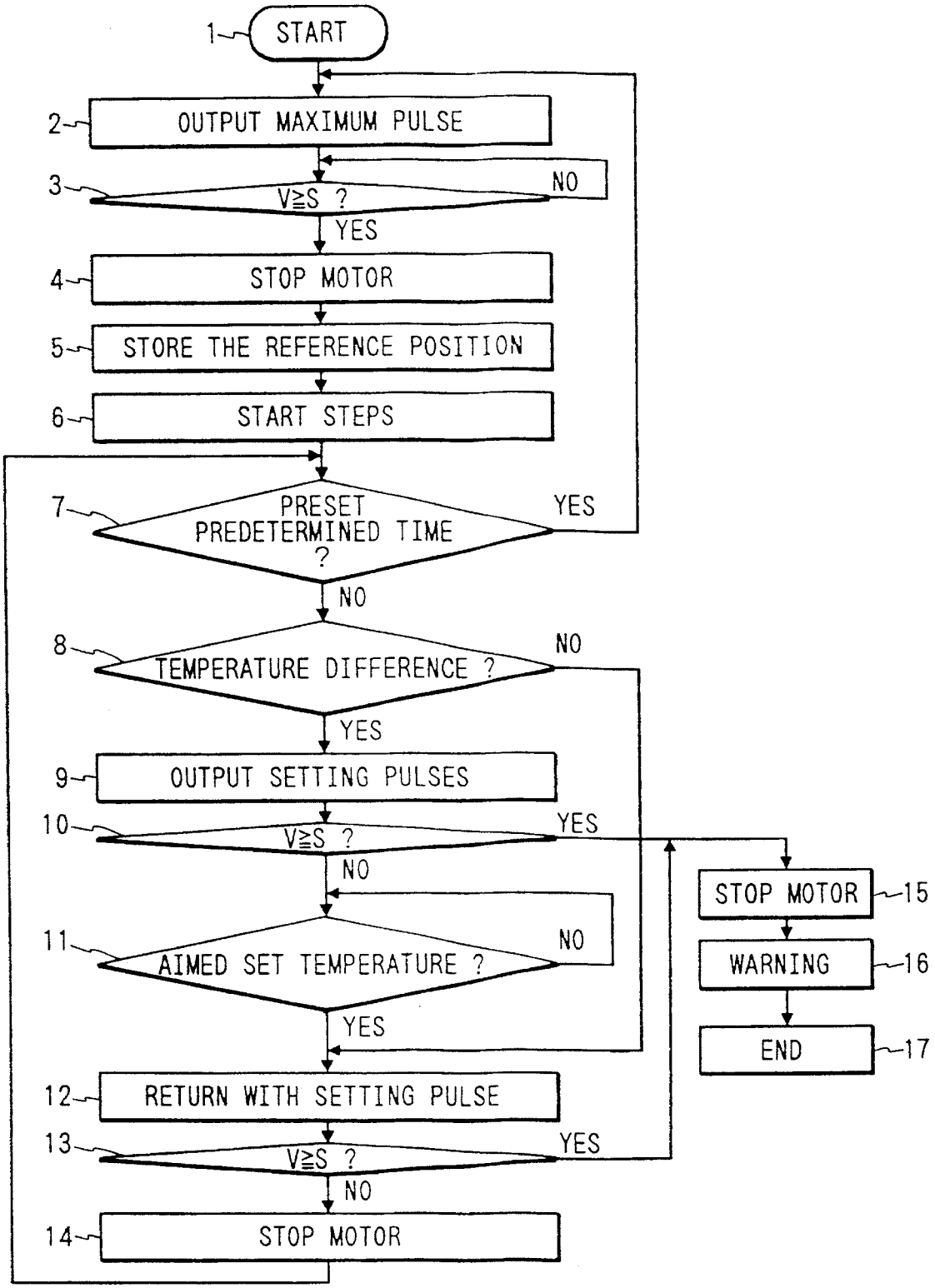
FIG. 5 is a flow chart for a description of the operation of the control section.

FIG. 5 shows the program according to the present invention. As was described above, the program is executed by the rotation control unit 20.

In Step 1, execution of the program is started. In Step 2 (Output maximum pulse), pulses are applied to the driver 21 to fully close the baffle 3. In this operation, the rotational direction of the motor 2 is clockwise with respect to the end face cam 11 in FIG. 3.

In Step 3 (V≧S?), the voltage V is measured with the measuring unit 22 while the baffle 3 is moved to a fully closed position. The voltage V is measured and then compared with the set threshold value S.

The set threshold value in this embodiment will be described below.

Figure 6A:
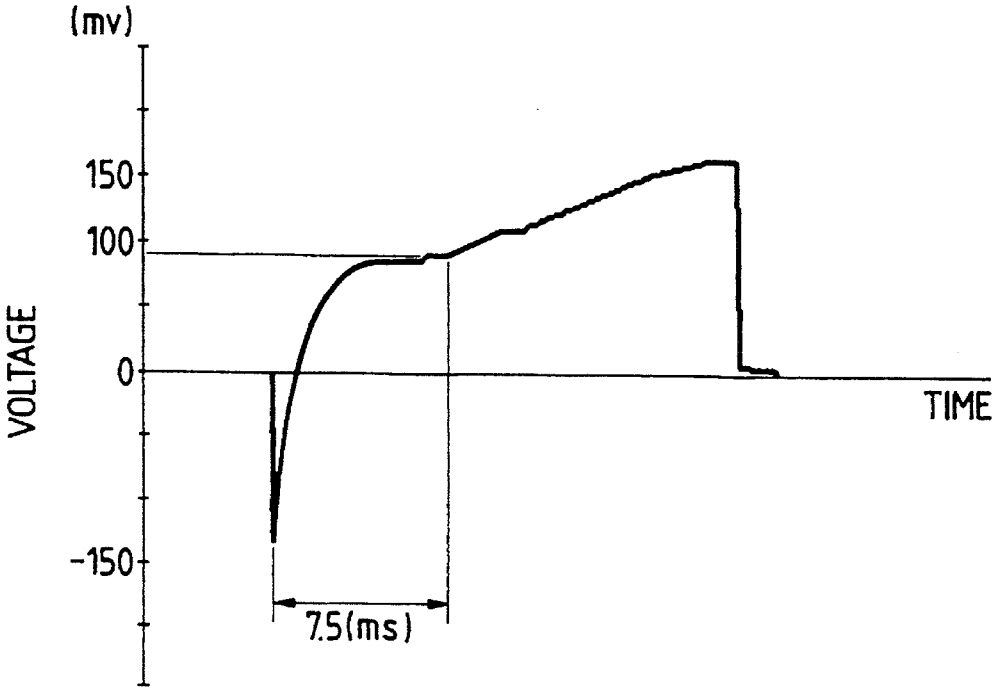
FIGS. 6(*a*) and 6(*b*) are graphical representations showing voltage signals in the control section.
Figure 6B:
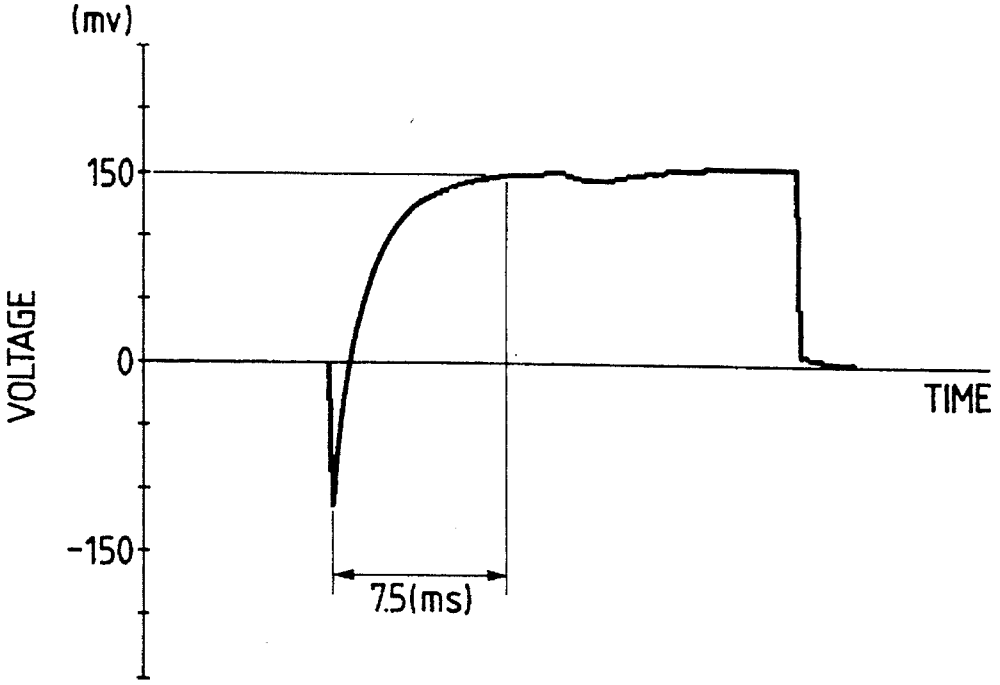

The parts (a) and (b) of FIG. 6 are graphical representations with time plotted on the horizontal axis, indicating variations of the voltage, in the form of a single pulse, which is applied to the stepping motor. When the baffle 3 is normally swung, the voltage rises as shown in the part (a) of FIG. 6. On the other hand, in the case where the stopper 16 is abutted against the reference position stopper 17 or the baffle 3 is freezed, the baffle 3 is held stopped. Therefore the voltage rises as shown in the part (b) of FIG. 6.

The difference in voltage which is measured 7.5 ms after its application can be utilized for determining whether the baffle 3 is normal in operation or locked. When the baffle is normal in operation, the voltage V is 90 mV; whereas when it is locked, it is 150 mV. Therefore, a threshold value to be set for the above-described determination exists between the 90 mV and 150 mV; for instance, it may be 130 mV. The threshold value is stored as the set value S in the memory unit 23 in advance.

Referring back to FIG. 5, when in Step 3 the voltage V is larger than or equal to the set value S; that is, the result of determination is "Yes", the following Step 4 is effected so that the stepping motor 2 is stopped. In the following Step 5, the stop position of the motor 2 is stored in the rotation control unit 20; more specifically it is stored as the number of pulses corresponding to the reference position where the stopper 16 abuts against the reference position stopper 17. Thus, the adjustment of the stepping-motor-operated damper 1 when built in the refrigerator has been accomplished. Hence, the number of pulses for driving the motor corresponds to the angle of the baffle which has been closed.

After the stepping-motor-operated damper 1 has been built in the refrigerator, Step 6 (in FIG. 5) is effected. When the damper is used for a long time, the reference position of the baffle may be shifted; that is, sometimes it is necessary to set the reference position again with a predetermined time preset. For this purpose, the timer is set by using an input unit of the rotation control unit 20. In Step 7, at the preset predetermined time, the above-described Steps 2 through 6 are performed all over again for confirmation of the reference position and the number of pulses corresponding to the reference position.

When it is not the preset predetermined time, a temperature control operation is started. First, in Step 8 (temperature difference?) it is determined whether or not an aimed set temperature is different from the present temperature. If there is no difference between the two temperatures, Step 12 is effected. If there is a difference between the two temperatures, Step 9 is effected. That is, in Step 9, the rotation control unit 20 applies setting pulses to the driver 21 according to the temperature difference to cause the driver 21 to open the baffle 3. In this operation, the number of setting pulses is proportional to the temperature difference, and therefore the degree of opening of the baffle 3 is proportional to the temperature difference. The number of pulses may be determined by taking the progress of the temperature difference or the rate of change of the temperature difference into consideration.

In the following Step 10 (V≧S?), the voltage V is measured while the baffle 3 is being opened. The voltage V thus measured is compared with the set value S. When V is smaller than S, Step 11 is effected. When V is larger than or equal to S, it is determined that the damper is in abnormal state, for instance being freezed, and Step 15 is effected. In Step 15, the stepping motor 2 is stopped, and a warning signal is generated when necessary. Thus, the operation is ended.

When in Step 10 the result of determination is "No", Step 11 (Aimed set temperature?) is effected. In Step 11, it is determined whether or not the temperature in the refrigerator has reached the aimed set temperature. When it is determined that the temperature in the refrigerator has reached the aimed set temperature, Step 12 (Return with setting pulses) is effected. In Step 12, the baffle is returned with the setting pulses which correspond to the pluses outputted in Step 9. Depending on the refrigerator, the amount of return of the baffle is made smaller than that which corresponds to the setting pulses outputted in Step 9, so that the baffle 2 is held slightly open. Thereafter, in Step 13, the voltage V is measured while the baffle is being returned with the setting pulses. The voltage V thus detected is compared with the set value S. When, in Step 13, V is larger than or equal to S, then it is determined that the damper is in abnormal condition, for instance being freeze, and Step 15 is effected. When V is smaller than S, the stepping motor 2 is stopped, and Step 7 is effected again; that is, the above-described operations are performed all over again.

Figure 7:
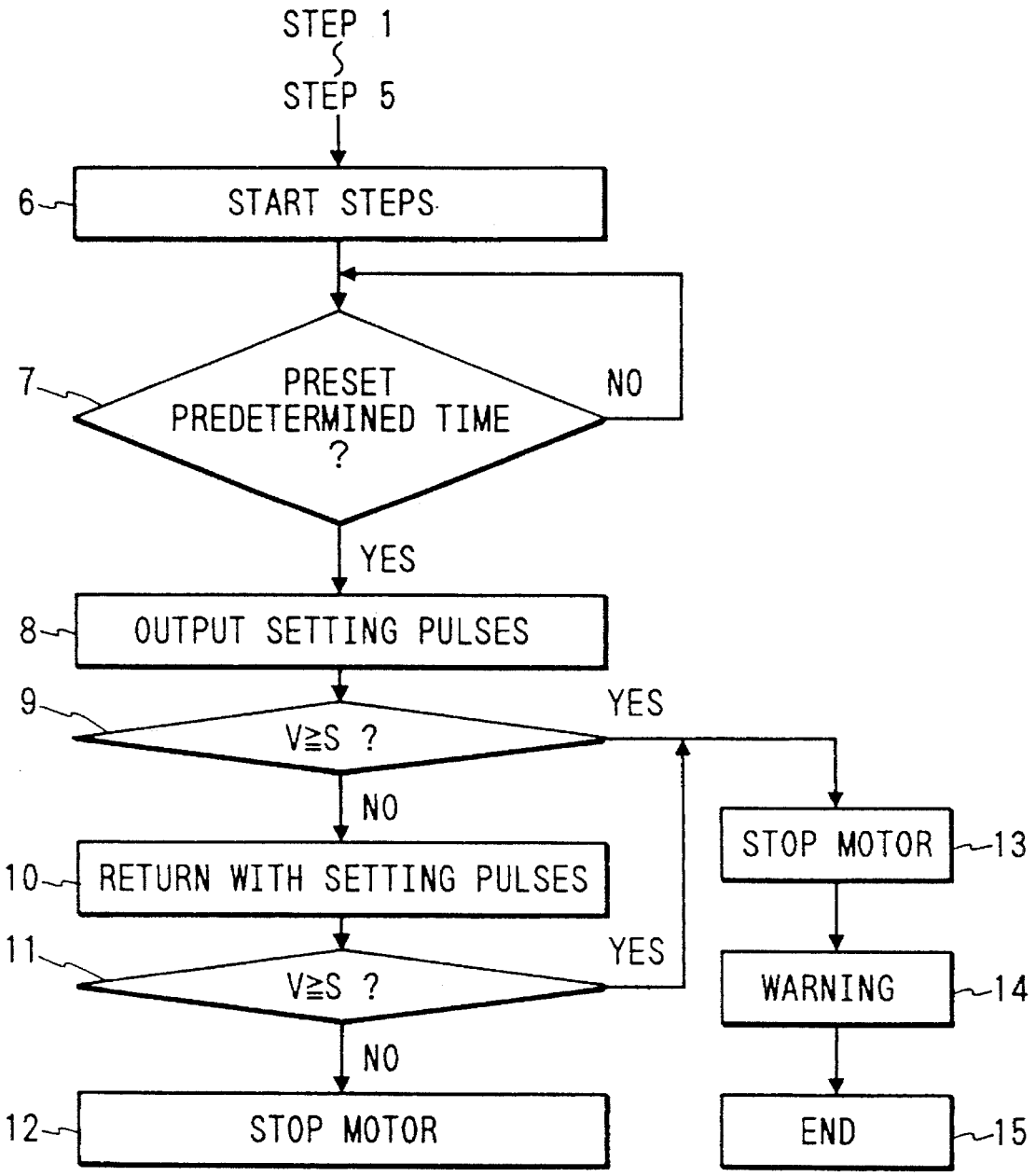
FIG. 7 is a flow chart for a description of an abnormal condition detecting operation.

FIG. 7 is a flow chart showing another example of the method of detecting the freezing of the refrigerator damper. The Steps in FIG. 7 may be provided after a series of Steps 1 through 6 and in parallel with Steps 7 through 17 in FIG. 5. In Step 6, the operation is started, and in Step 7 it is determined whether or not a predetermined time set in advance has occurred. The predetermined time is set optionally according to the frequency of detecting the freezing of the refrigerator damper. For instance, it may be set so as to occur every predetermined period of time, or whenever the baffle 3 is driven a predetermined number of times.

In the following Step 8, setting pulses which are required for detecting the freezing of the damper are applied to the driver 21, so that the baffle 3 is swung by the stepping motor 2. In this operation, the voltage V which is applied to the stepping motor 2 is measured with the measuring unit 22. The voltage V thus measured is applied to the comparison unit 23, where it is compared with the set value S. When V is larger than or equal to S, it is determined that the damper is in abnormal state, being for instance freezed. As a result, Steps 13, 14 and 15 are effected; that is, the motor is stopped, and the warning signal is generated, and the operation is ended.

When V is smaller than S, in Step 10 pulses which are required for returning the baffle 3 to the reference position are applied to the driver 21. In the following Step 11, the voltage V is measured while the baffle 3 is being driven. The voltage V which is measured is compared with the set value S. When V is larger than or equal to S, it is determined that the damper is in abnormal state, being for instance freezed, and Steps 13, 14 and 15 are effected. When V is smaller than S, Step 12 is effected; that is, the stepping motor is stopped.

In the above-described embodiment, immediately after the application of the pulse voltage, the state of rise thereof is read. However, the stop of the damper may be detected by using current instead of voltage, or by integrating the waveform of voltage or current.

In the method according to the present invention, the amount of rotation of the stepping motor is controlled to open and close the baffle. Hence, it is unnecessary to use a switch for controlling the operation of the baffle, which eliminates the difficulty that the damper becomes out of order because of the freezing of the switch. Furthermore, in the method of the invention, the stepping motor is used for controlling the degree of opening of the baffle. This feature makes it possible to perform a temperature adjusting operation, so that the temperature of the refrigerator can be finely controlled. In addition, the baffle can be so driven that it is not completely closed. That is, by substantially closing the baffle, the deformations with time of the cold air intake and the baffle's packing can be prevented. Furthermore, by detecting the variations in electrical drive signal it can be determined whether the baffle is opened or closed and whether or not the baffle is locked by freezing. Hence, the abnormal condition of the stepping-motor-operated damper can be detected at an early stage. In addition, when the damper is installed for a refrigerator, the initial setting of the reference position of the baffle can be achieved with ease.

What is claimed is:

1. A device for detecting the stop of a stepping-motor-operated damper for a refrigerator, said damper comprising: a stepping motor; a baffle driven by said stepping motor; and rotation control means for controlling the direction of rotation and the amount of rotation of said stepping motor, said device comprising:

memory means for storing an electrical signal as a set value for determining a position where said baffle is stopped, measuring means for measuring an electrical drive signal provided when said baffle is being driven, comparison means for comparing said electrical drive signal with said set value, and stop detecting means for determining that said baffle has been stopped when said comparison means determines that said electrical drive signal is larger than said set value, to output a stop signal.

2. A device as claimed in claim 1, in which said electrical drive signal and said set value represent voltage values.

3. A device as claimed in claim 1, in which said electrical drive signal and said set value represent current values.

4. A method of detecting the stop of a stepping-motor-operated damper for a refrigerator, said damper comprising: a stepping motor; a baffle driven by said stepping motor; and rotation control means for controlling the direction of rotation and the amount of rotation of said stepping motor, said device comprising:

memory means for storing an electrical signal as a set value for determining a position where said baffle is stopped, measuring means for measuring an electrical drive signal provided when said baffle is being driven, comparison means for comparing said electrical drive signal with said set value, and stop detecting means for determining that said baffle has been locked when said comparison means determines that said electrical drive signal is larger than said set value, to output a stop signal, wherein said method further comprises steps of:

first moving said baffle so as to be closed, detecting a reference position of said baffle, said reference position being a position of said baffle when said baffle is closed, storing an electrical drive signal provided when said reference position is detected, controlling the amount of opening of said baffle with reference to said reference position, and detecting the stop of said baffle according to the following relation:

$$V \geqq S,$$

where V is the electrical drive signal detected when said baffle is being opened and S is the set value.

5. A method as claimed in claim 4, wherein said step of controlling the amount of opening of said baffle includes the step of holding said baffle at least partially open when said baffle is returned.

6. A method as claimed in claim 4, wherein said step of detecting the reference position is applied every predetermined period of time.

7. A method as claimed in claim 4, wherein said step of detecting the reference position is applied whenever said baffle is driven a predetermined number of times.

* * * * *